US009961975B1

(12) United States Patent
Tong

(10) Patent No.: US 9,961,975 B1
(45) Date of Patent: May 8, 2018

(54) SIDE OPENING, SIDE HANGING LUGGAGE

(71) Applicant: Joy Tong, Boca Raton, FL (US)

(72) Inventor: Joy Tong, Boca Raton, FL (US)

( * ) Notice: Subject to any disclaimer, the term of this patent is extended or adjusted under 35 U.S.C. 154(b) by 0 days. days.

(21) Appl. No.: 15/471,280

(22) Filed: Mar. 28, 2017

(51) Int. Cl.

| | |
|---|---|
| ***A45C 13/04*** | (2006.01) |
| ***A45C 5/03*** | (2006.01) |
| ***A45C 5/14*** | (2006.01) |
| ***A45C 13/26*** | (2006.01) |
| ***A45C 13/10*** | (2006.01) |
| ***A45C 13/03*** | (2006.01) |

(52) U.S. Cl.
CPC ..... *A45C 5/03* (2013.01); *A45C 5/14* (2013.01); *A45C 13/03* (2013.01); *A45C 13/103* (2013.01); *A45C 13/262* (2013.01); *A45C 2005/035* (2013.01)

(58) Field of Classification Search
CPC ..... A45C 13/103; A45C 13/262; A45C 3/004; A45C 13/04
USPC ..... 190/903, 24; 206/287.1; D3/103
See application file for complete search history.

(56) References Cited

U.S. PATENT DOCUMENTS

| | | | | |
|---|---|---|---|---|
| 3,768,610 | A * | 10/1973 | Housel | A45C 3/00 190/113 |
| 4,736,854 | A * | 4/1988 | King | A45C 3/004 206/286 |
| 4,738,360 | A * | 4/1988 | King | A45C 3/004 206/280 |
| 5,501,324 | A * | 3/1996 | Franklin | A45C 3/004 190/109 |
| 5,566,797 | A | 10/1996 | Van Himbeeck | |
| 6,276,501 | B1 | 8/2001 | Tong | |
| 6,612,413 | B2 | 9/2003 | Kuwayama | |
| 8,636,123 | B2 | 1/2014 | Santy et al. | |
| 2002/0148743 | A1 * | 10/2002 | Tong | A45C 3/00 206/288 |
| 2012/0247898 | A1 | 10/2012 | Martucci | |
| 2017/0127782 | A1 * | 5/2017 | Korey | A45C 5/03 |
| 2017/0196346 | A1 * | 7/2017 | Guyton | A45F 3/047 |

* cited by examiner

*Primary Examiner* — Sue A Weaver
(74) *Attorney, Agent, or Firm* — Pai Patent & Trademark Law Firm; Chao-Chang David Pai

(57) ABSTRACT

A side opening, side hanging luggage includes a luggage housing having an internal skeleton and a fabric wrap and defining an opening in a front panel and a side panel thereof, a side cover panel connected to the side panel and adapted for closing the opening, a zip fastener for closing or opening the side cover panel, a clothes hanger buckle and other accessories mounted inside the luggage housing for holding stored clothes flat.

8 Claims, 4 Drawing Sheets

SIDE OPENING, SIDE HANGING LUGGAGE

BACKGROUND OF THE INVENTION (a) Field of the Invention

The present invention relates to luggage technology and more particularly to a side opening, side hanging luggage, which has an opening located in a front panel and a side panel thereof, and a side cover panel connected to the side panel and mounted with a zip fastener for closing the opening, so that the user can open the luggage housing sideways and store clothes in the luggage housing in a flat manner, achieving quick storage.

(b) Description of the Prior Art

Many luggage designs are known. U.S. Pat. No. 8,636,123 and US20120247898 teach the use of textile body for attaching to a thin resilient wire hoop to resist distortion of the luggage case. U.S. Pat. No. 6,612,413 discloses a luggage that includes an outer cloth, an inner cloth secured to the outer cloth, a frame disposed between the outer cloth and the inner cloth, two or four casters pivoted to the bottom plate of the frame, and a retractable handle provided at the back side of the luggage. However, these prior art luggage designs simply provide an opening at the front side of the luggage case. When placing a suit jacket or coat in the luggage, the user needs to fold up the suit jacket or coat so that folded suit jacket or coat can be put through the front opening of the luggage into the inside of the luggage case, resulting in suit jacket wrinkles, and lowering the speed for storing the clothes.

In order to facilitate receiving suit jacket, coat and other garment, three-sided fully open luggage structures have been created. Similar designs are seen in U.S. Pat. No. 5,566,797 and U.S. Pat. No. 6,276,501. These two designs provide an opening in the front side and two opposite lateral sides of the luggage housing. The height of the opening in each of the front and lateral sides of the luggage housing is the same. The internal frame structure of the luggage housing is a one piece frame plate that exhibits a C-shaped profile when viewed from one lateral side, resulting in insufficient supporting capability and low structural strength. Thus, the luggage can easily be deformed or damaged. The C-shaped one piece frame plate cannot give sufficient support, and its weight is still very heavy. In order to mate with the three-sided opening leads, a long zip fastener shall be used, thus, it takes much labor and time to open this long zip fastener.

SUMMARY OF THE INVENTION

The present invention has been accomplished under the circumstances in view. It is one object of the present invention to provide a side opening, side hanging luggage, which has an opening located in a front panel and a side panel thereof, and a side cover panel connected to the side panel and mounted with a zip fastener for closing the opening, so that the user can open the luggage housing sideways and store clothes in the luggage housing in a flat manner, achieving quick storage.

It is another object of the present invention to provide a side opening, side hanging luggage, which has a clothes hanger buckle and triangle zipper bags mounted in the luggage housing for allowing lateral placement of clothes without folding.

It is still another object of the present invention to provide a side opening, side hanging luggage, which uses a light weight internal skeleton to support the fabric wrap of the luggage, providing sufficient structural strength and minimizing the weight of the side opening, side hanging luggage.

Other advantages and features of the present invention will be fully understood by reference to the following specification in conjunction with the accompanying drawings, in which like reference signs denote like components of structure.

DETAILED DESCRIPTION OF THE PREFERRED EMBODIMENTS

Figure 1:
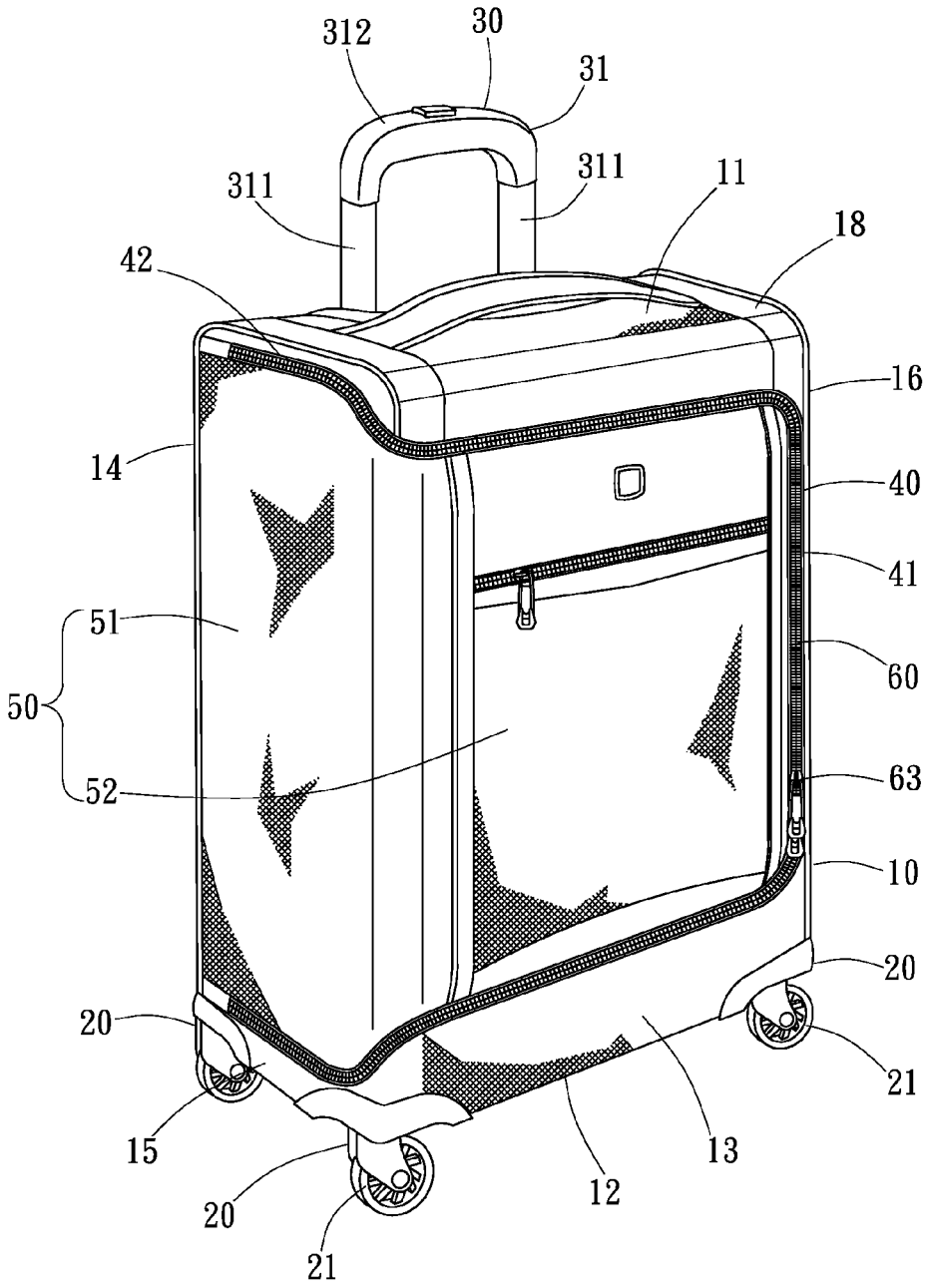
FIG. 1 is an oblique top elevational view of a side opening, side hanging luggage in accordance with the present invention.
Figure 3:
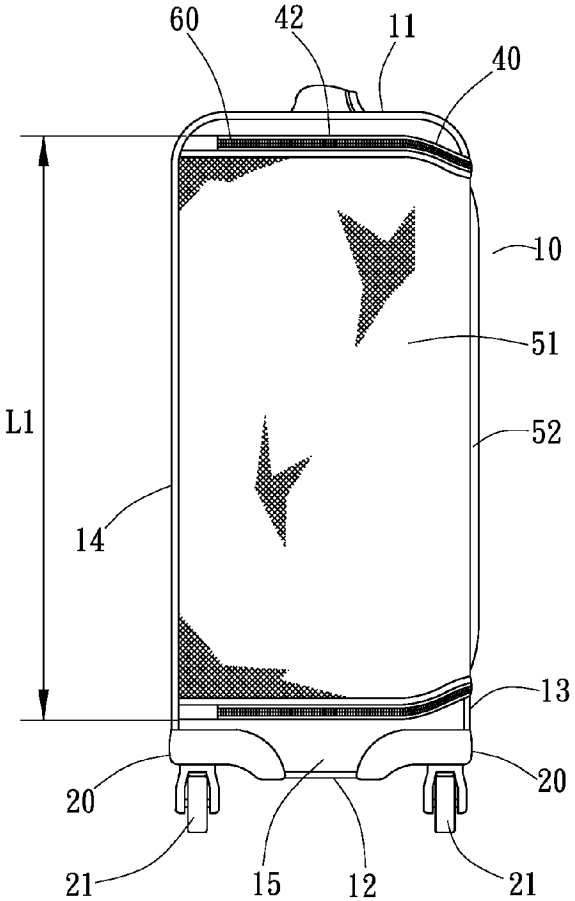
FIG. 3 is a schematic drawing illustrating the outer appearance of the first side panel of the side opening, side hanging luggage in accordance with the present invention.
Figure 2:
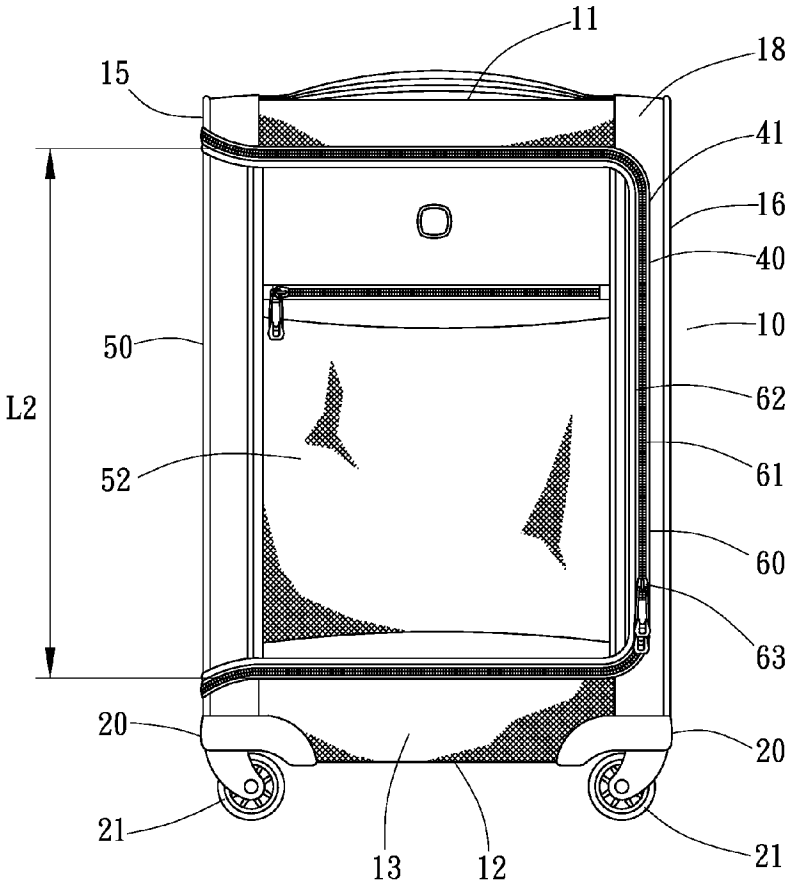
FIG. 2 is a schematic front view of the side opening, side hanging luggage in accordance with the present invention.

Referring to FIG. 1, FIG. 2 and FIG. 3, a side opening, side hanging luggage in accordance with the present invention is shown. As illustrated, the side opening, side hanging luggage comprises a luggage housing 10, a plurality of wheel modules 20, a retractable handle assembly 30, an opening 40, a side cover panel 50 and a zip fastener 60.

Figure 5:
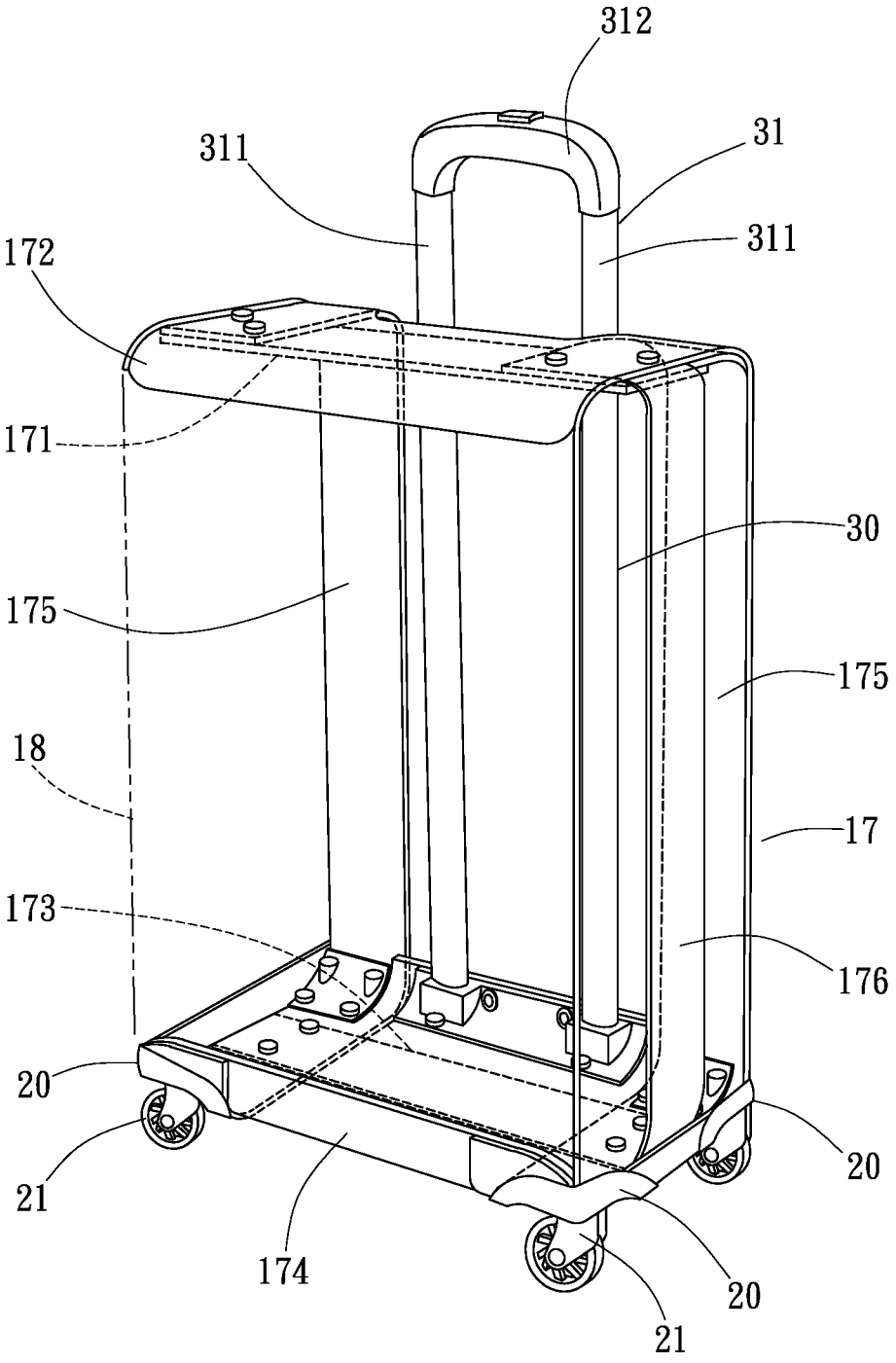
FIG. 5 is a schematic perspective view of the luggage in accordance with the present invention, illustrating the structure of the internal skeleton.

The luggage housing 10 is a hollow rectangular housing, comprising a top panel 11, a bottom panel 12 opposite to the top panel 11, a front panel 13 connected between a front side of the top panel 11 and a front side of the bottom panel 12, a back panel 14 connected between a rear side of the top panel 11 and a rear side of the bottom panel 12, and a first side panel 15 and a second side panel 16 respectively connected between two opposite lateral sides of the front panel 13 and two opposite lateral sides of the back panel 14. Further, as illustrated in FIG. 1 and FIG. 5, the luggage housing 10 comprises an internal skeleton 17, and a fabric wrap 18 wrapped about opposing inner and outer surfaces of the internal skeleton 17. The fabric wrap 18 is a bag formed by stitching multiple pieces of fabric together in the desired shape. Thus, the internal skeleton 17 supports the fabric wrap 18 in shape, enabling the fabric wrap 18 to form the top panel 11, the bottom panel 12, the front panel 13, the back panel 14, the first side panel 15 and the second side panel 16.

The wheel modules 20 are fixedly mounted at a bottom side of the bottom panel 12 of the luggage housing 10. In the present preferred embodiment, there are four wheel modules 20 respectively fixedly mounted at the bottom side of the bottom panel 12 of the luggage housing 10. Each wheel module 20 comprises at least one rotatable wheel 21. By means of the wheel modules 20, the luggage housing 10 can be moved on the floor.

The retractable handle assembly 30 is mounted at the back panel 14 of the luggage housing 10, and covered by the fabric wrap 18 with a retractable handle 31 thereof exposed to the outside of the top panel 11 of the luggage housing 10, allowing the retractable handle 31 to be moved in or out of the top panel 11 of the luggage housing 10. In the present preferred embodiment, the retractable handle 31 comprises two retractable bar 311 and a grip 312 connected between respective top ends of the retractable bars 311. Thus, through the retractable handle assembly 30, the user can conveniently drag the luggage housing 10.

Figure 4:
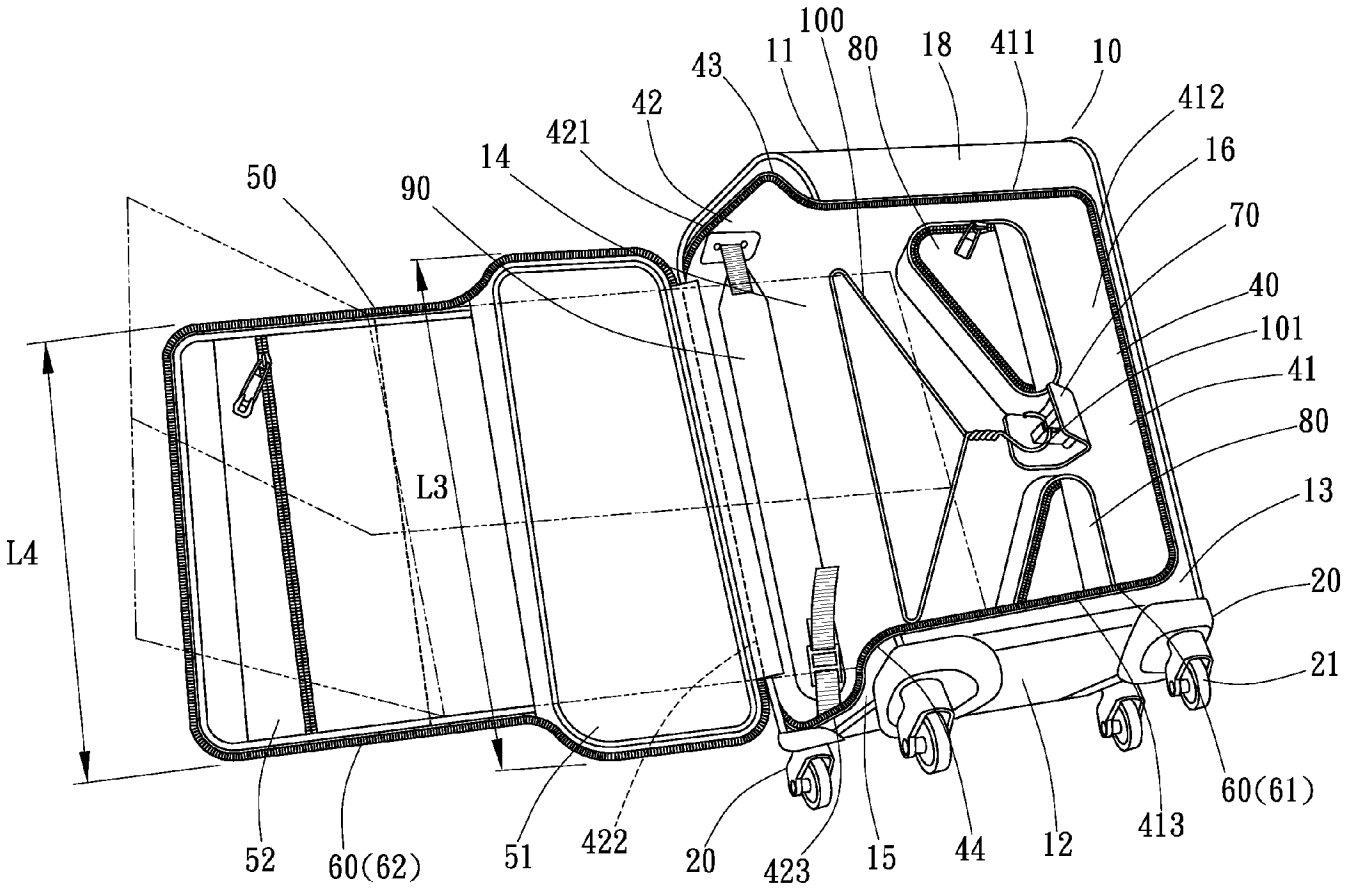
FIG. 4 is a schematic elevational view of the luggage in accordance with the present invention, illustrating the side cover panel having been flipped out.

The opening 40, as illustrated in FIG. 1 and FIG. 4, is formed in the fabric wrap 18, defining a rectangular front opening 41 that is located in the front panel 13 of the luggage housing 10 and a rectangular side opening 42 that is located in the first side panel 15 of the luggage housing 10. The front opening 41 has one side disposed in communication with one side of the side opening 42. The front panel 13 and first side panel 15 of the luggage housing 10 can be opened, for allowing the user to put clothes and other personal items in the luggage housing 10. Further, the front opening 41 defines a first top edge 411, a first side edge 412 and a first bottom edge 413 that are connected in series; the side opening 42 defines a second top edge 421, a second side edge 422 and a second bottom edge 423 that are connected in series. Further, the first top edge 411 of the front opening 41 is connected with the second top edge 421 of the side opening 42; the first bottom edge 413 of the front opening 41 is connected with the second bottom edge 423 of the side opening 42. More specifically, the first top edge 411 of the front opening 41 abuts the top panel 11; the first bottom edge 413 abuts the bottom panel 12; the first side edge 412 abuts the second side panel 16; the second top edge 421 of the side opening 42 abuts the top panel 11; the second bottom edge 423 abuts the bottom panel 12; the second side edge 422 abuts the back panel 14.

The side cover panel 50, as illustrated in FIG. 1 and FIG. 4, is a cover member matching with the front opening 41 and the side opening 42 in shape, preferably formed by stitching multiple pieces of fabric together in the desired shape. The side cover panel 50 comprises a side cover portion 51 matching the shape of the side opening 42, and a front cover portion 52 matching the shape of the front opening 41. The height L3 of the side cover portion 51 is greater than the height L4 of the front cover portion 52. The side cover portion 51 has one end thereof connected to one end of the front cover portion 52, and an opposite end thereof inseparably connected to the second side edge 422 of the side opening 42. Thus, the side cover panel 50 can be flipped up, enabling the side cover portion 51 and the front cover portion 52 to cover the side opening 42 and the front opening 41, or to open the side opening 42 and the front opening 41.

The zip fastener 60 is a commercial product, comprising two zipper tapes 61, 62 and a zipper slider 63 operable to close or open the two zipper tapes 61, 62. One zipper tape 61 extends along the border of the front opening 41 and the border of the side opening 42, namely, it extends along the second top edge 421, the first top edge 411, the first side edge 412, the first bottom edge 413 and the second bottom edge 423, and is then stitched to a border edge of the front opening 41 and a border edge of the side opening 42. The other zipper tape 62 extends along the border of the side cover panel 50, and is then stitched to a border edge of the side cover panel 50. When the side cover panel 50 is covered on the front opening 41 and the side opening 42, the user can operate the zipper slider 63 to close the two zipper tapes 61, 62, thereby enclosing the front opening 41 and the side opening 42.

Based on the above-described design, the side opening, side hanging luggage of the present invention further comprise a clothes hanger buckle 70 and two triangle zipper bags 80 mounted in the luggage housing 10 for allowing lateral placement of clothes without folding. The clothes hanger buckle 70 is a commercially available product. It is fixedly mounted at the inner surface of the second side panel 16 for securing the clothes hanger hook 101 of a triangle clothes hanger or one of multiple triangle clothes hangers 100. Referring also to FIG. 1 and FIG. 4, the height L1 between the second top edge 421 and the second bottom edge 423 of the side opening 42 of the opening 40 is greater than the height L2 between the first top edge 411 and the first bottom edge 413 of the front opening 41. Further, the first top edge 411 and the second top edge 421 are connected by a S-shaped connection strip 43; the first bottom edge 413 and the second bottom edge 423 are connected by a S-shaped connection strip 44. Thus, the user can put a suit jacket, shirt or other garment on one triangle clothes hanger 100, and then place the suit jacket, shirt or garment sideways in the luggage housing 10 with the collar thereof facing toward the inner surface of the second side panel 16, and then fasten the triangle clothes hanger 100 to the clothes hanger buckle 70, and then fold up the hem of the suit jacket, shirt or garment into the inside of the luggage housing 10, keeping the stored suit jacket, shirt or garment flat. Thus, the side opening, side hanging luggage enables the user to store clothes quickly. Further, the triangle zipper bags 80 can be used to keep the triangle clothes hanger 100 in position, and the inside space of the triangle zipper bag 80 can be used for storing socks, underwear, ties and other small personal things.

Referring to FIG. 4, the side opening, side hanging luggage further comprises a fastening strap 90 mounted in the luggage housing 10 for securing clothes. The fastening strap 90 has one end thereof fixedly connected to the inner surface of the top panel 11 of the luggage housing 10, and an opposite end thereof joined to the inner surface of the bottom panel 12 of the luggage housing 10, thus the fastening strap 90 is disposed adjacent to the second side edge 422 of the side opening 42 and closely kept in contact with the inner surface of the back panel 14 of the luggage housing 10 for holding down clothes.

Referring to FIG. 5, the internal skeleton 17 of the luggage housing 10 preferably comprises a rectangular top frame plate 171, a first arched frame plate 172 connected to the rectangular top frame plate 171 and working with the rectangular top frame plate 171 to support the top panel 11 of the luggage housing 10, a rectangular bottom frame plate 173 disposed opposite to the rectangular top frame plate 171, a second arched frame plate 174 connected to the rectangular bottom frame plate 173 and working with the rectangular bottom frame plate 173 to support the bottom panel 12 of the luggage housing 10, two back frame plates 175 having a substantially C-shaped cross section when viewed sideways and bilaterally and fixedly connected between the rectangular top frame plate 171 and the rectangular bottom frame plate 173 at a back side for supporting the back panel 14 of the luggage housing 10, and a side frame plate 176 fixedly connected between one end of the rectangular top frame plate 171 and one end of the rectangular bottom frame plate 173 for supporting the second side panel 16 of the luggage housing 10. Further, the wheel modules 20 are fixedly mounted at the bottom side of the back frame plate 175; the retractable handle assembly 30 is fixedly mounted between a back side of the first arched frame plate 172 and a back side of the second arched frame plate 174.

The structural design of the internal skeleton 17 enables the front opening 41 and side opening 42 of the opening 40 to be maintained in shape without collapsing. Further, the internal skeleton 17 is formed by fastening multiple plastic plate members into shape, so that the weight of the side opening, side hanging luggage can be kept as small as possible.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A side opening, side hanging luggage, comprising:

a luggage housing, said luggage housing comprising an internal skeleton, a top panel, a bottom panel opposite to said top panel, a front panel connected between a front side of said top panel and a front side of said bottom panel, a back panel connected between a rear side of said top panel and a rear side of said bottom panel, and a first side panel and a second side panel respectively connected between two opposite lateral sides of said front panel and two opposite lateral sides of said back panel;

a plurality of wheel modules respectively mounted at a bottom side of said bottom panel of said luggage housing, each said wheel module comprising at least one rotating wheel;

a retractable handle assembly mounted at said back panel of said luggage housing, said retractable handle assembly comprising a retractable handle movable in and out of said top panel of said luggage housing;

an opening comprising a front opening located in said front panel of said luggage housing and a side opening located in said first side panel of said luggage housing and disposed in communication with said front opening, said front opening defining a first top edge, a first side edge and a first bottom edge, said side opening defining a second top edge, a second side edge and a second bottom edge, said first top edge of said front opening being connected to said second top edge of said side opening, said first bottom edge of said front opening being connected to said second bottom edge of said side opening, the height between said second top edge and said second bottom edge of said side opening being greater than the height between said first top edge and said first bottom edge of said front opening, said first top edge and said second top edge being connected together by a first S-shaped connection strip, said first bottom edge and said second bottom edge being connected together by a second S-shaped connection strip;

a side cover panel comprising a side cover portion matching said side opening in shape and a front cover portion matching said front opening in shape, the height of said side cover portion being greater than the height of said front cover portion, said side cover portion having one end thereof connected to one end of said front cover portion and an opposite end thereof inseparably connected to said second side edge of said side opening, said side cover portion and said front cover portion adapted for covering said side opening and said front opening respectively; and a zip fastener comprising two zipper tapes and at least one zipper slider slidable to open and close said two zipper tapes, one said zipper tape extending along a border of said front opening and a border of said side opening and stitched to a border edge of said front opening and a border edge of said side opening, the other said zipper tape extending along a border of said side cover portion and said front cover portion of said side cover panel and stitched to a border edge of said side cover panel, wherein said internal skeleton comprises a rectangular top frame plate, a first arched frame plate connected to said rectangular top frame plate and working with said rectangular top frame plate to support said top panel of said luggage housing, a rectangular bottom frame plate disposed opposite to said rectangular top frame plate, a second arched frame plate connected to said rectangular bottom frame plate and working with said rectangular bottom frame plate to support said bottom panel of said luggage housing, two back frame plates fixedly connected between said rectangular top frame plate and said rectangular bottom frame plate at a back side for supporting said back panel of said luggage housing, and a side frame plate fixedly connected between one end of said rectangular top frame plate and one end of said rectangular bottom frame plate for supporting said second side panel of the luggage housing;

said plurality of wheel modules are fixedly mounted at a bottom side of said back frame plate; and said retractable handle assembly is fixedly mounted between a back side of said first arched frame plate and a back side of said second arched frame plate.

2. The side opening, side hanging luggage as claimed in claim 1, wherein said first top edge of said front opening abuts said top panel; said first bottom edge abuts said bottom panel;

said first side edge abuts said second side panel; said second top edge of said side opening abuts said top panel; said second bottom edge abuts said bottom panel; and said second side edge abuts said back panel.

3. The side opening, side hanging luggage as claimed in claim 1, wherein the plurality of wheel modules includes four said wheel modules.

4. The side opening, side hanging luggage as claimed in claim 1, further comprising a clothes hanger buckle mounted at an inner surface of said second side panel inside said luggage housing.

5. The side opening, side hanging luggage as claimed in claim 4, further comprising two triangle zipper bags mounted at an inner surface of said second side panel inside said luggage housing and disposed at two opposite lateral sides relative to said clothes hanger buckle.

6. The side opening, side hanging luggage as claimed in claim 1, further comprising a fastening strap mounted inside said luggage housing for holding down stored clothes, said fastening strap having one end thereof fixedly connected to an inner surface of said top panel of said luggage housing and an opposite end thereof joined to an inner surface of said bottom panel of said luggage housing, said fastening strap being disposed adjacent to said second side edge of said side opening and closely kept in contact with an inner surface of said back panel of said luggage housing.

7. The side opening, side hanging luggage as claimed in claim 1, wherein a fabric wrap is wrapped about said internal skeleton, said fabric wrap being made by stitching multiple pieces of fabric together to form said top panel, said bottom panel, said front panel, said back panel, said first side panel and said second side panel.

8. The side opening, side hanging luggage as claimed in claim 1, wherein said side cover panel is formed by stitching multiple pieces of fabric together.

* * * * *